US006895925B2

(12) United States Patent
Hannon et al.

(10) Patent No.: US 6,895,925 B2
(45) Date of Patent: May 24, 2005

(54) INTERNAL COMBUSTION ENGINE HAVING THREE VALVES PER CYLINDER

(75) Inventors: Mark S. Hannon, South Lyon, MI (US); James R. Klotz, Clemens, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 101 days.

(21) Appl. No.: 10/245,970

(22) Filed: Sep. 18, 2002

(65) Prior Publication Data

US 2004/0050361 A1 Mar. 18, 2004

(51) Int. Cl.[7] ..... F02P 15/02; F01L 1/26

(52) U.S. Cl. ..... 123/310; 123/90.22; 123/90.4; 123/432

(58) Field of Search ..... 123/90.39, 308, 123/310, 432, 54.4–54.8, 90.22, 90.23, 90.4

(56) References Cited

U.S. PATENT DOCUMENTS

| | | | | | |
|---|---|---|---|---|---|
| 1,915,237 | A | * | 6/1933 | Moore | 123/432 |
| 2,309,291 | A | * | 1/1943 | Anderson et al. | 123/90.22 |
| 2,647,499 | A | * | 8/1953 | Gustav | 123/90.22 |
| 2,713,855 | A | * | 7/1955 | Witzky | 123/90.4 |
| 2,713,856 | A | * | 7/1955 | Turlay | 123/90.54 |
| 3,884,199 | A | | 5/1975 | Irimajiri et al. | 123/90.61 |
| 3,942,490 | A | | 3/1976 | Scott | 123/90.4 |
| 4,480,625 | A | | 11/1984 | Kanda et al. | 123/661 |
| 4,494,489 | A | | 1/1985 | Seidl | 123/41.31 |
| 4,527,518 | A | | 7/1985 | Osaki et al. | 123/90.23 |
| 4,773,360 | A | | 9/1988 | Heimburg | 123/90.23 |
| 4,773,382 | A | | 9/1988 | Smith, Jr. et al. | 123/661 |
| 4,932,377 | A | | 6/1990 | Lyle | 123/432 |
| 5,007,387 | A | | 4/1991 | Arao | 123/90.22 |
| 5,042,438 | A | | 8/1991 | Heil et al. | 123/90.27 |
| 5,042,440 | A | | 8/1991 | Joseph | 123/193.5 |
| 5,553,572 | A | | 9/1996 | Ochiai | 123/90.14 |
| 5,577,470 | A | | 11/1996 | Leydorf, Jr. et al. | 123/90.36 |
| 5,598,630 | A | | 2/1997 | Savoyard et al. | 29/888.06 |
| 5,626,110 | A | | 5/1997 | Regueiro | 123/90.22 |
| 5,636,613 | A | | 6/1997 | Aoyama et al. | 123/432 |
| 5,638,787 | A | | 6/1997 | Feuling | 123/310 |
| 5,829,400 | A | | 11/1998 | Speil et al. | 123/90.22 |
| 5,873,341 | A | | 2/1999 | Smith, Jr. et al. | 123/193.5 |
| 5,893,348 | A | | 4/1999 | Feuling | 123/310 |
| 6,032,627 | A | * | 3/2000 | Brogdon et al. | 123/90.22 |
| 6,055,958 | A | | 5/2000 | Aoyama et al. | 123/308 |
| 6,082,318 | A | | 7/2000 | Malatto et al. | 123/193.5 |
| 6,098,581 | A | | 8/2000 | Buck et al. | 123/90.17 |
| 6,199,544 | B1 | | 3/2001 | Feuling | 123/661 |
| 6,205,966 | B1 | * | 3/2001 | Breitenberger | 123/90.39 |
| 6,213,074 | B1 | | 4/2001 | Freese | 123/90.38 |
| 6,267,096 | B1 | | 7/2001 | Vallance et al. | 123/301 |
| 6,505,589 | B1 | | 1/2003 | Hayman et al. | 123/90.23 |
| 6,505,591 | B1 | | 1/2003 | Hayman et al. | 123/90.39 |
| 6,505,592 | B1 | | 1/2003 | Hayman et al. | 123/90.61 |

FOREIGN PATENT DOCUMENTS

| | | | | |
|---|---|---|---|---|
| DE | 004214800 A1 | * | 11/1993 | 123/90.22 |

* cited by examiner

*Primary Examiner*—Tony M. Argenbright
(74) *Attorney, Agent, or Firm*—Thomas A. Jurecko

(57) ABSTRACT

A valve train is disclosed for an internal combustion engine having a block, a camshaft in the block, and at least two push rods actuated by the camshaft. The valve train comprises first and second rockers, and three valves. The first rocker is actuated by one of the push rods, and the second rocker is actuated by another of the push rods. A first valve is associated with a cylinder of the engine and actuated by the first rocker. A second valve is associated with the cylinder and actuated by the first rocker, and a third valve is associated with the cylinder and actuated by the second rocker.

7 Claims, 7 Drawing Sheets

INTERNAL COMBUSTION ENGINE HAVING THREE VALVES PER CYLINDER

TECHNICAL FIELD OF THE INVENTION

This invention relates generally to internal combustion engines for motor vehicles, and relates more particularly to an internal combustion engine having three valves per cylinder.

BACKGROUND OF THE INVENTION

Internal combustion engines arranged with their cylinders in a V-shape and using push rods are well known. The valves in such engines may be actuated from a single, centrally located camshaft. In a common arrangement, the valves are angled toward a centerline of the engine to give a generally wedge-shaped combustion chamber. An engine of this type usually operates with each valve having one push rod, and each push rod corresponding to one cam lobe.

Internal combustion engines with three valves per cylinder, including two intake valves, are also known. In such a three valve per cylinder design, the two intake valves may be driven by a bridged rocker spanning the intake valves and actuated by a single cam lobe. It should be noted that this practice of operating two valves with one rocker arm is used in four valve overhead camshaft engines wherein two valves are actuated by a similar rocker employing a roller at camshaft lobe. A significant advantage of the three valve push rod architecture verses a four valve overhead camshaft cylinder head is an appreciable performance gain using a much simpler compact design. The three valve push rod device would not use the large sprockets, multiple camshafts, and belt or chain structure created in overhead camshaft engines.

SUMMARY OF THE INVENTION

The present invention is a valve train for an internal combustion engine having a block, a camshaft in the block, and at least two push rods actuated by the camshaft. The valve train comprises first and second rockers, and three valves. The first rocker is actuated by one of the push rods, and the second rocker is actuated by another of the push rods. A first valve is associated with a cylinder of the engine and actuated by the first rocker. A second valve is associated with the cylinder and actuated by the first rocker, and a third valve is associated with the cylinder and actuated by the second rocker.

Accordingly, it is an object of the present invention to provide an internal combustion engine including a valve train of the type described above that is relatively compact.

Another object of the present invention is to provide an internal combustion engine including a valve train of the type described above that uses one rocker shaft per cylinder bank.

Another object of the present invention to is to provide a cylinder head assembly including a valve train of the type described above that is relatively simple and inexpensive to manufacture.

Another object of the present invention is to provide an internal combustion engine including a valve train of the type described above that uses single or dual point ignition and timing.

Still another object of the present invention is to provide a cylinder head that has canted valves and a wedge-shaped combustion chamber.

These and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
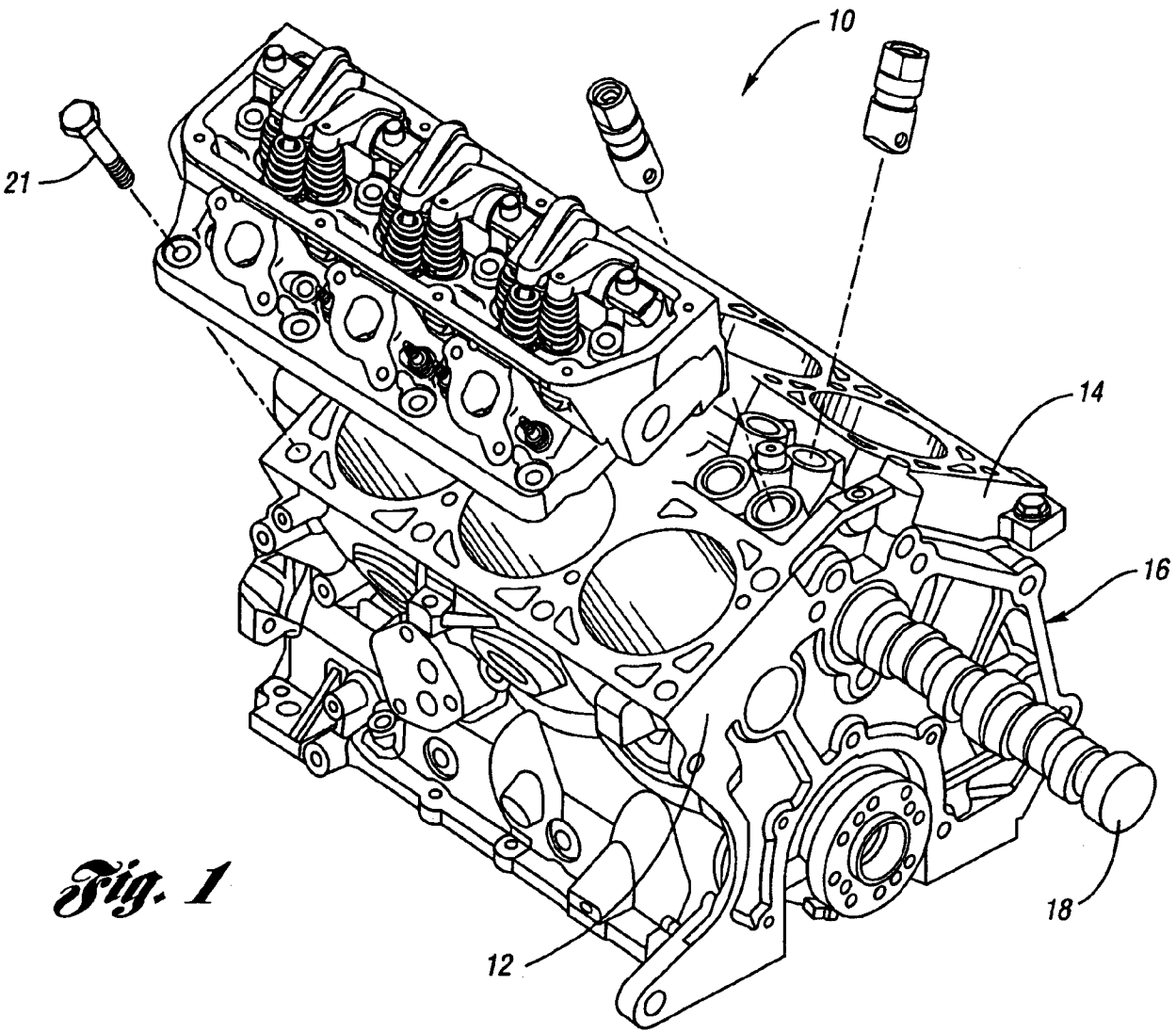
FIG. 1 is an exploded perspective view of an internal combustion engine according to the present invention.

FIG. 1 shows one embodiment 10 of an internal combustion engine according to the present invention. The engine 10 is preferably a 3.0 to 3.8 liter displacement, and most preferably a 3.3 liter displacement, motor vehicle engine having two banks 12 and 14 of three cylinders arranged in a 60 degree V shape in a block 16. A camshaft 18 is journaled in the block 16, and a cylinder head assembly 20 is connected to the block by bolts 21.

Figure 2:
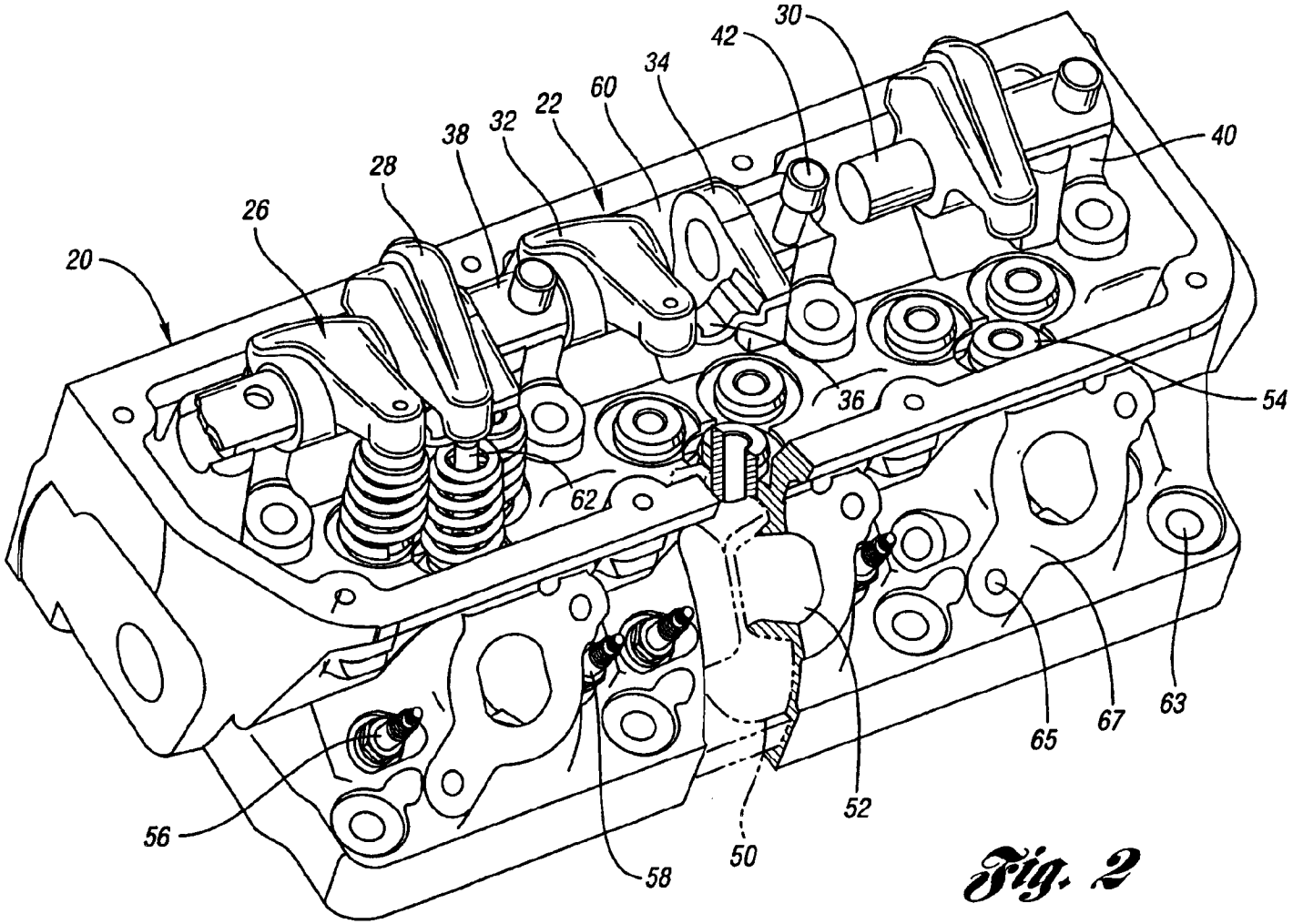
FIG. 2 is a partially cut away perspective view of one bank of a cylinder head assembly for the internal combustion engine with portions removed for purposes of illustration.
Figure 3:
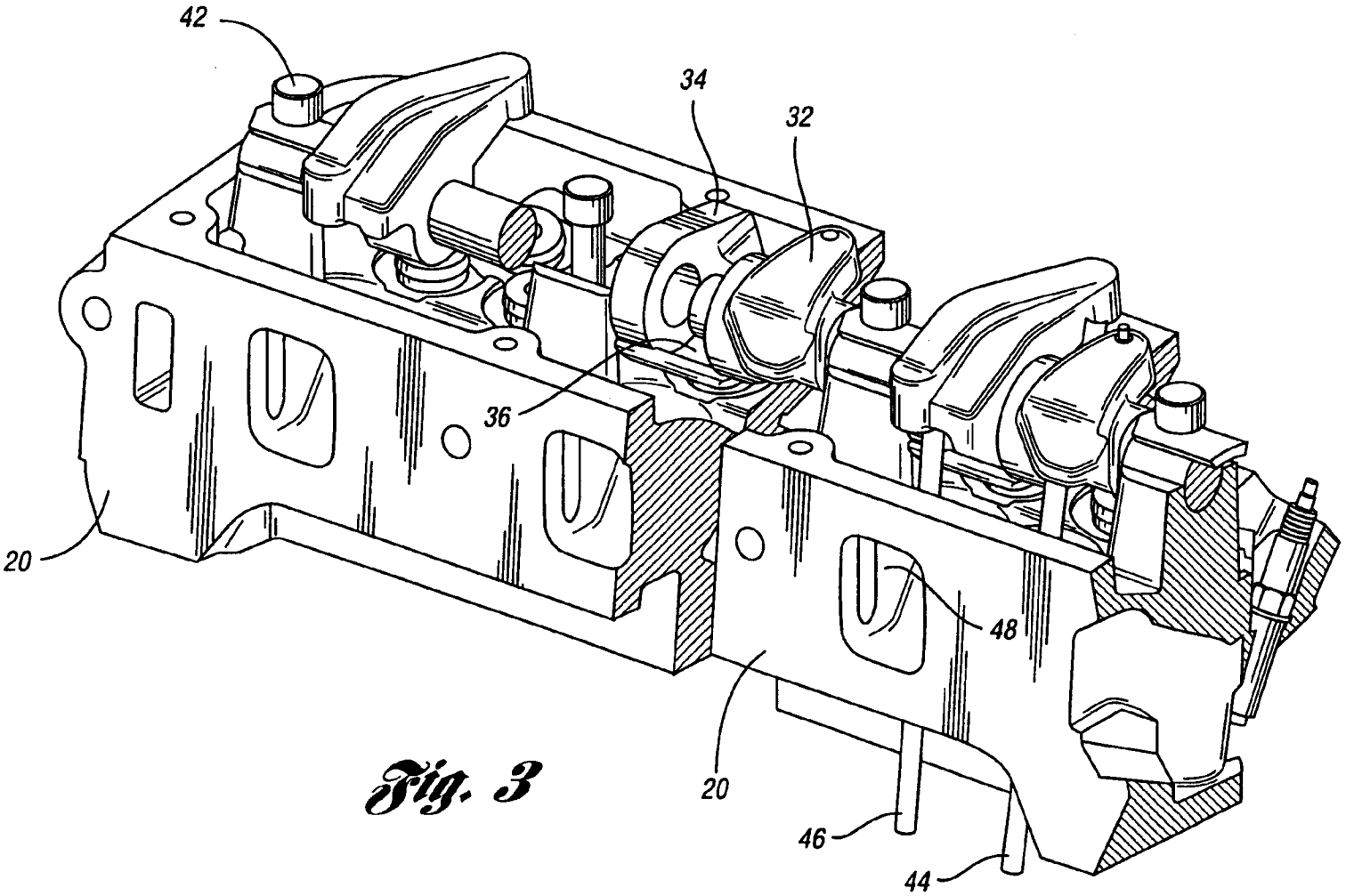
FIG. 3 is a partially cut away perspective view of the back side of the cylinder head assembly with portions removed for purposes of illustration.

As FIGS. 2 and 3 show, the cylinder head assembly 20 includes a valve train 22 having intake rocker assemblies 26 and exhaust rockers 28 rotatably mounted on a rocker shaft 30. The intake rocker assemblies 26 each include a pair of intake rockers 32 and 34 joined by a web 36 for additional stiffness to inhibit twisting. The rockers 26 and 28 are spaced apart by retainers 38, which in turn are mounted to the rocker shaft 30 and to cylinder head pedestals 40 by fasteners 42. An intake push rod 44 and an exhaust push rod 46 actuated by the camshaft 18 straddle an exhaust passage 48 at each cylinder for actuation of the rockers 26 and 28, respectively. It should be appreciated that while the present invention is shown with a single intake passage for each cylinder, the present invention also contemplates a split intake passage around the exhaust push rod for each cylinder.

A water jacket 50 circumvents intake ports 52 and exhaust valve guides 54 to cool the cylinder head assembly 20. The water jacket 50 also has a relatively generous radius for smoother flow and to minimize eddying. Each cylinder is also preferably provided with dual spark plugs 56 and 58 that may be used for timed ignition, although it should be understood that the present invention contemplates a single spark plug per cylinder. Each exhaust rocker 28 is disposed within a pocket 60 of a corresponding intake rocker assembly 26, and extends into engagement with an exhaust valve 62. Head bolt holes 63 are provided in the cast cylinder head for the bolts 21, and tapped holes 65 are provided on surfaces 67 for mounting an exhaust manifold (not shown).

Figure 4:
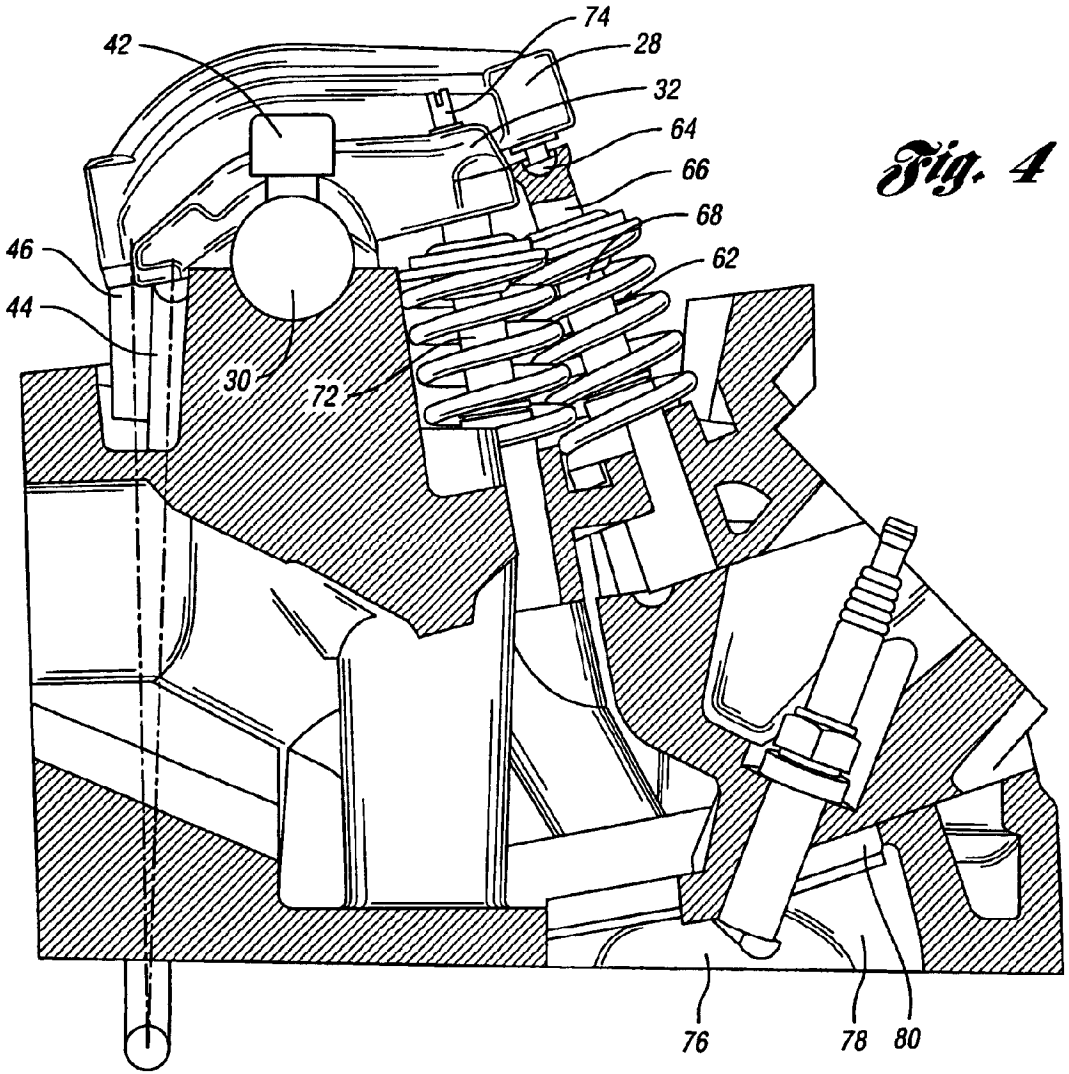
FIG. 4 is a cross-sectional view of a portion of the cylinder head assembly.

As shown in FIG. 4, a swivel 64 is pressed into the exhaust rocker 28 contacting a valve tip 66 of each valve stem 68 to minimize any scrub event at the valve tip. The exhaust valve stem 68 is longer than a valve stem of intake valves 72 to establish a relationship with the axis of the rocker shaft 30 for an acceptable rocker geometry, and to minimize scrub characteristics. The exhaust push rod 46 is angled relative to the intake push rod 44 to similarly achieve a suitable rocker ratio for the exhaust rocker 28. An adjustable swivel 74 is threaded into the intake rockers 32 and 34 to adjust the relative lash of the intake valves 72.

A generally wedge-shaped combustion chamber 76 is provided in the cylinder head assembly 20, and includes a cavity 78 adjacent an exhaust valve seat 80. The exhaust valves 62 are inclined or canted toward the exhaust rocker 28 and toward the middle of the V shape of the engine 10. This slanting of the exhaust valves 62 permits the intake rockers 26 to be coaxial with the exhaust rockers 28 while maintaining a desirable rocker ratio such as in the range of about 1.5 to 1.

Figure 5:
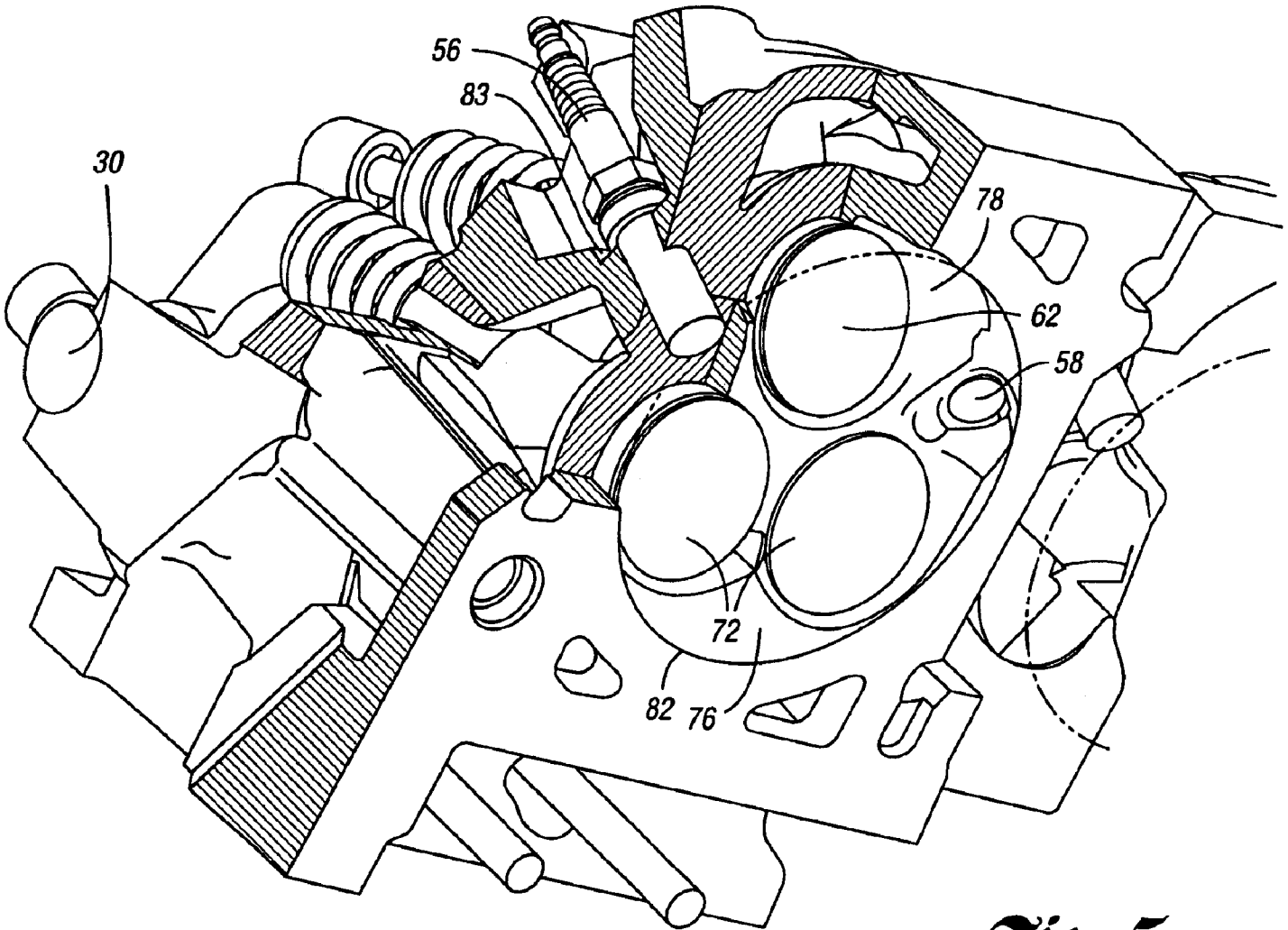
FIG. 5 is a partially cut away perspective view of a combustion chamber of the cylinder head assembly.

As shown in FIG. 5, the spark plugs 56 and 58 enter the combustion chamber 76 proximate the periphery of the cylinder bore 82 and on opposite sides of the head of the exhaust valve 62. The tips of the spark plugs 56 and 58 are preferably positioned proximate the intake valves 72 for efficient ignition. The spark plugs 56 and 58 also preferably extend from the combustion chamber 76 at an angle to the cylinder axis in order to provide both a pocket 83 for socket clearance of each spark plug and maximum clearance for the water jacket around the exhaust port. The cavity 78 seen clearly in FIG. 5 allows for assembly and reciprocation of the exhaust valve 62.

Figure 6A:
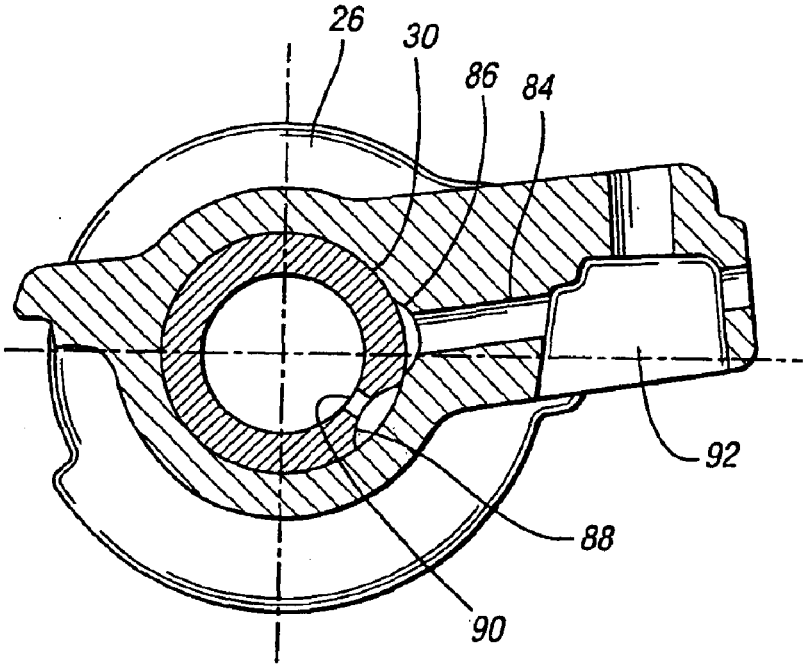
FIG. 6A is a cross-sectional view of an optional intake rocker of the cylinder head assembly in a valve closed position.
Figure 6B:
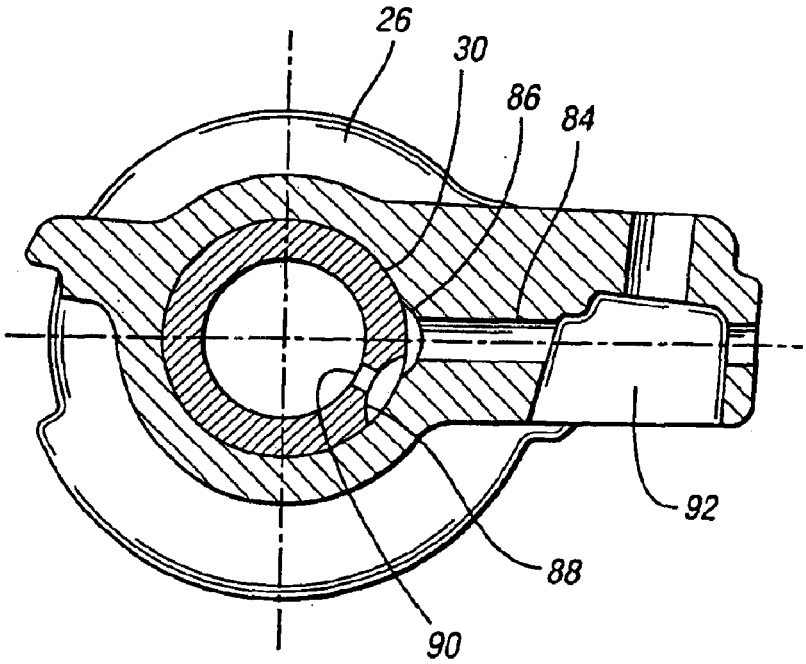
FIG. 6B is a cross-sectional view similar to FIG. 6A and showing the intake rocker in a valve stroked position.

FIGS. 6A and 6B respectively show an optional pulse lubrication system for the engine 10. A lubrication hole 84 in the intake rocker 26 communicates a linear scalloped area 86 with the main rocker shaft 30. In the valve closed position as shown in FIG. 6A, oil disposed within the hollow rocker shaft 30 does not communicate with the lubrication passage 84. As the intake rocker 26 rotates on shaft 30 to the position shown in FIG. 6B, a scalloped area 88 in the exterior surface of the rocker shaft 30 and a hole 90 communicate with the scalloped area 86 and the passage 84, allowing lubrication oil to flow toward a tip 92 of the rocker 26. Reciprocation of the rocker 26 thus develops a pulsing lubrication system. It should be appreciated that the engine 10 may alternately be provided with hydraulic adjusters between the rockers and the valves and/or solid rocker shafts.

Figure 7:
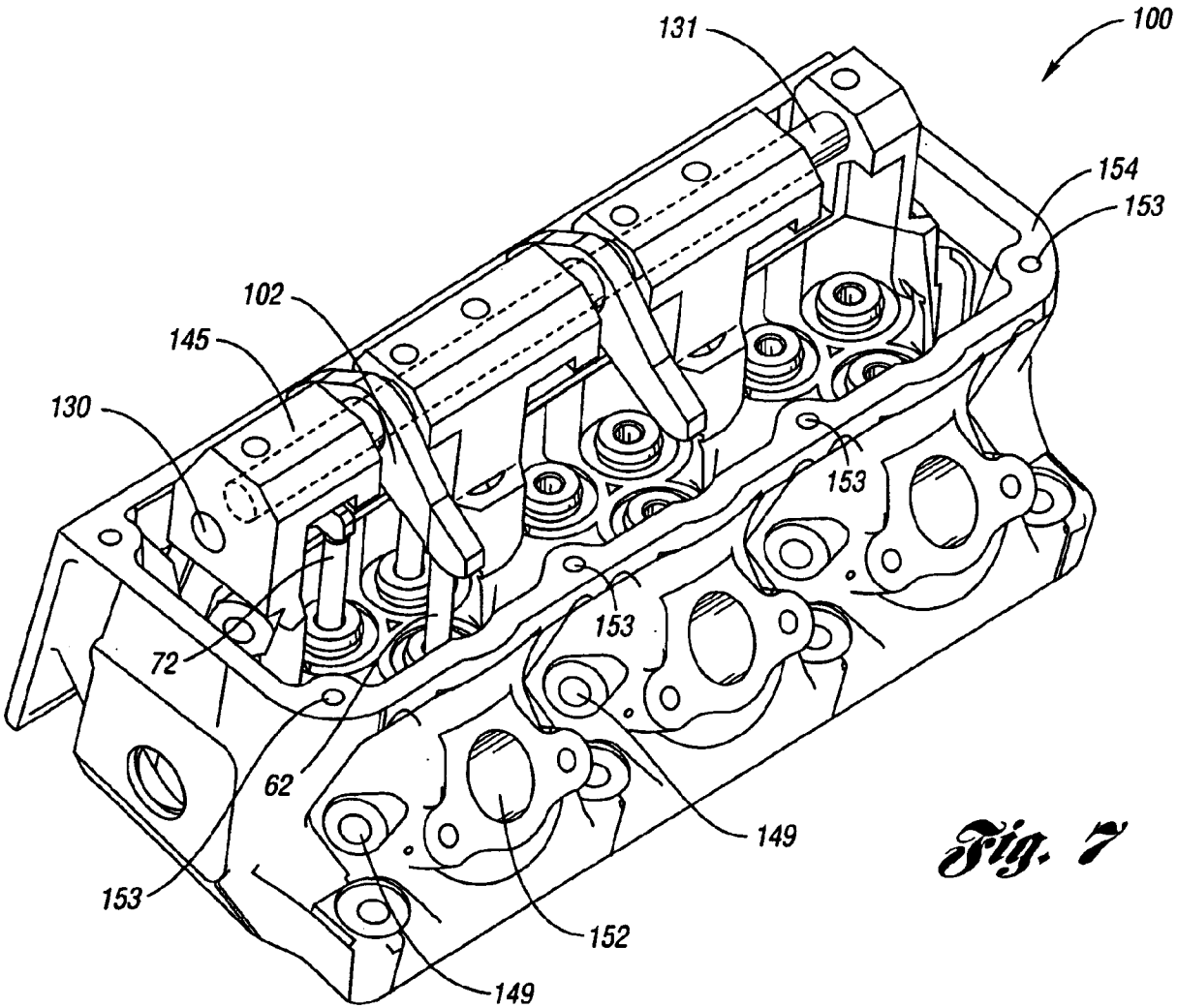
FIG. 7 is a perspective view similar to FIG. 1 and showing an alternative embodiment of the cylinder head assembly.

FIG. 7 shows an alternative embodiment 100 of the cylinder head assembly in which the desirable rocker ratio is maintained with the exhaust valves 62 disposed in parallel to the intake valves 72. In this arrangement, an intake rocker shaft 130 and a separate exhaust rocker shaft 131 are provided in a carrier 145. This parallel valve embodiment uses a longer reaching exhaust rocker 102 to maintain the acceptable rocker ratio. Dual spark plug taps 149 are provided next to exhaust ports 152. Taps 153 are provided in a surface 154 to mount a valve cover to the cylinder head assembly 100.

The present invention thus provides a multivalve wedge combustion chamber with relative performance, cost, and fuel economy advantages. At the same time, the canted valve orientation generates a simple, compact single shaft rocker system. It should also be appreciated that this invention is applicable to in-line engines, engines with cam in block and overhead camshaft engines. While the embodiments of the invention disclosed herein are presently considered to be preferred, various changes and modifications can be made without departing from the spirit and scope of the invention. For example, the present invention contemplates the integration of valve lift changing means for improved fuel consumption. The scope of the invention is indicated in the appended claims, and all changes that come within the meaning and range of equivalents are intended to be embraced therein.

What is claimed is:

1. A valve train for an internal combustion engine having a block, a camshaft in the block, and at least two gush rods actuated by the camshaft, the valve train comprising:

a first rocker actuated by one of the push rods;

a second rocker actuated by another of the push rods;

a first valve associated with a cylinder of the engine and actuated by the first rocker;

a second valve associated with the cylinder and actuated by the first rocker; and a third valve associated with the cylinder and actuated by the second rocker, wherein the first rocker and the second rocker are disposed on a common shaft and wherein the engine has at least a second cylinder arranged in a V shape with the first cylinder, and the exhaust valve is inclined toward the middle of the V.

2. The valve train of claim 1 wherein the first and second valves comprise intake valves.

3. The valve train of claim 1 wherein the valve train has a 1.5 to 1 rocker ratio.

4. The valve train of claim 1 wherein the first rocker comprises a pair of rockers joined by a web, and the second rocker is positioned on the common shaft between the pair of rockers.

5. An internal combustion engine comprising:

a block;

a camshaft in the block;

at least two push rods actuated by the camshaft;

a cylinder head connected to the block; and a valve train including a first rocker actuated by one of the push rods, a second rocker actuated by another of the push rods, a first intake valve associated with a cylinder of the engine and actuated by the first rocker, a second intake valve associated with the cylinder and actuated by the first rocker, and an exhaust valve associated with the cylinder and actuated by the second rocker, wherein the engine has at least a second cylinder arranged in a V shape with the first cylinder, and the exhaust valve is inclined toward the middle of the V.

6. The internal combustion engine of claim 5 wherein the valve train has a 1.5 to 1 rocker ratio.

7. The internal combustion engine of claim 5 further comprising at least two spark plugs disposed in the cylinder head.

* * * * *